US006510667B1

(12) United States Patent
Cottier et al.

(10) Patent No.: US 6,510,667 B1
(45) Date of Patent: Jan. 28, 2003

(54) WALL MEMBER AND METHOD OF CONSTRUCTION THEREOF

(75) Inventors: John Sydney Cottier, Oatley; David Robert Collins, Alfords Point; James Graham Geeves, Baulkham Hills, all of (AU)

(73) Assignee: James Hardie Research Pty Limited (AU)

( * ) Notice: Subject to any disclaimer, the term of this patent is extended or adjusted under 35 U.S.C. 154(b) by 0 days.

(21) Appl. No.: 09/284,724

(22) PCT Filed: Oct. 15, 1997

(86) PCT No.: PCT/AU97/00692

§ 371 (c)(1),
(2), (4) Date: Nov. 24, 1999

(87) PCT Pub. No.: WO98/16697

PCT Pub. Date: Apr. 23, 1998

(30) Foreign Application Priority Data

Oct. 16, 1996 (AU) ..... PO3032

(51) Int. Cl.[7] ..... E04B 2/54; E04B 2/86

(52) U.S. Cl. ..... 52/742.14; 52/404.1; 52/481.1; 52/323; 52/310; 52/449

(58) Field of Search ..... 52/741.1, 742.1, 52/742.13, 742.14, 742.16, 323, 404.1, 425, 426, 449, 437, 310, 745.05, 481.1

(56) References Cited

U.S. PATENT DOCUMENTS

| | | | | |
|---|---|---|---|---|
| 1,630,801 A | | 5/1927 | Parsons | |
| 1,698,557 A | | 1/1929 | O'Brien | |
| 3,481,093 A | * | 12/1969 | Davidson | 52/426 |
| 3,869,295 A | | 3/1975 | Bowles et al. | |
| 3,986,312 A | | 10/1976 | Calhoun et al. | |
| 4,052,829 A | * | 10/1977 | Chapman | 52/449 X |
| 4,076,884 A | * | 2/1978 | Riley et al. | 428/255 |
| 4,366,657 A | | 1/1983 | Hopman | |
| 4,373,957 A | * | 2/1983 | Pedersen | 106/93 |
| 4,895,598 A | * | 1/1990 | Hedberg et al. | 106/86 |
| 5,117,600 A | * | 6/1992 | Yerushalmi | 52/426 X |
| 5,397,631 A | | 3/1995 | Green et al. | |
| 5,622,556 A | * | 4/1997 | Shulman | 106/677 |
| 5,724,783 A | * | 3/1998 | Mandish | 52/745.05 |
| 5,736,594 A | * | 4/1998 | Boles et al. | 524/2 |
| 6,030,447 A | | 2/2000 | Naji et al. | |

FOREIGN PATENT DOCUMENTS

| | | |
|---|---|---|
| EP | 558239 | 12/1943 |
| EP | 564447 | 9/1944 |
| EP | 1086311 | 10/1967 |
| EP | L 174902 | 12/1969 |
| EP | WO 81/02758 | 10/1981 |
| EP | 0305209 | 3/1989 |
| JP | 06278116 A | 4/1994 |
| TW | 278536 | 6/1996 |
| TW | 278537 | 6/1996 |
| TW | 282800 | 8/1996 |
| WO | WO93/24711 | 12/1993 |
| WO | WO 97/08111 | 3/1997 |

OTHER PUBLICATIONS

Translation of Taiwanese Patent Office Decision of Appeal and Opposition.

* cited by examiner

*Primary Examiner*—Carl D. Friedman
*Assistant Examiner*—Winnie Yip
(74) *Attorney, Agent, or Firm*—Knobbe, Martens, Olson & Bear, LLP

(57) ABSTRACT

A process for constructing a wall, floor or ceiling in situ. The process includes the steps of erecting a substantially rigid frame (10) and attaching fiber reinforced cementitious sheets (50) to the front and rear faces of the frame to form a void (60) therebetween. This void (60) is then filled with a lightweight aggregate concrete slurry and allowed to cure. The sheets are adapted to absorb sufficient moisture from the lightweight aggregate slurry to provide natural adherence of the concrete slurry to the sheets without substantially losing their structural integrity during setting and curing of the concrete slurry.

21 Claims, 3 Drawing Sheets

WALL MEMBER AND METHOD OF CONSTRUCTION THEREOF

TECHNICAL FIELD

The present invention relates to an improved wall, floor or ceiling and method of construction thereof.

BACKGROUND ART

There is a great demand in the building industry for a lightweight contemporary monolithic wall system as an alternative to traditional brick or block work at a more attractive price and offering greater design flexibility. There is also a great demand to reduce the time of construction of traditional masonry walling systems.

There are many lightweight stucco or "rendered" masonry lookalike systems utilising traditional stud framing covered with sheeting materials and rendered or coated to achieve a masonry appearance. Whilst these systems give the appearance of masonry they do not achieve the "feel" or solidarity of masonry.

There are also many masonry panel systems currently available. Generally, panels of this type are manufactured by filling the space between two adjacent fibre reinforced cement (FRC) sheets with a lightweight concrete core. These panel systems, however, are generally constructed off-site and incur substantial transport costs. Further, the panel themselves are quite heavy and require cranage or considerable man handling to install. The panels are also inflexible with regard to design, and are generally only being provided as a two-dimensional panel, leading to further costs for on-site cutting.

Conventional on-site production of cast concrete walls, floors or ceilings requires complex and bulky formwork, to define the desired wall, floor or ceiling which is then filled with a conventional concrete/aggregate mix. The heavy concrete/aggregate mix places substantial stress on formwork and is unsuitable to produce lightweight walls, floors or ceilings. Further one has all the added difficulties associated with producing, transporting and installing such heavyweight material.

It is an object of the present invention to overcome or substantially ameliorate at least some of the disadvantages of the prior art.

DISCLOSURE OF THE INVENTION

Accordingly, the invention provides a method of constructing a wall, floor or ceiling in situ, wherein said method includes the steps of:

erecting a substantially rigid frame defining front and rear faces of a wall, floor or ceiling;

attaching fibre reinforced cementitious sheets to said front and rear faces, to form a void therebetween;

injecting a lightweight aggregate concrete slurry with a density between 200 kg/m$^3$ and 1800 kg/m$^3$ into said void;

and allowing said concrete slurry to set and cure;

wherein said sheets are adapted to absorb sufficient moisture to provide natural adherence of said concrete slurry to said sheets without substantially losing their structural integrity during setting and curing.

The present invention in a preferred form provides a method for constructing walls, floors or ceilings which has greater flexibility than current prefabricated systems and which is easier and cheaper to use than current conventional on-site systems while still retaining the desired look and feel of masonry.

Not all fibre reinforced cement sheets are suitable for the inventive process. Sheets which are suitable for use with the present inventive construction method are adapted to:

(i) absorb sufficient moisture to provide natural adherence of the concrete to the sheets following curing; and (ii) substantially maintain their structural integrity during curing.

Both the moisture permeability and/or thickness of the sheet(s) may be adjusted to meet these criteria.

As will be clear to persons skilled in the art, when the water borne lightweight aggregate concrete slurry is poured into the void between the sheets, the FRC sheets will absorb a certain quantity of water. This absorption of water is required so that as the concrete firstly sets then cures it naturally adheres to the cementitious sheets.

As the fibre cement sheets absorb moisture, they lose strength. If moisture absorption continues, the sheets may be weakened to such an extent that the weight of the slurry is sufficient to cause total loss of structural integrity of the sheets and escape of the cement slurry from the void between the sheets. The present applicants have surprisingly found, however, that it is possible to provide sheets which absorb sufficient moisture to allow for natural adherence of the concrete but which still substantially maintain their structural integrity during setting and curing of the concrete. This is particularly useful since it allows for production of lightweight walls, ceiling or floors on-site which give the solid feel and look of conventional masonry without the need for additional formwork or reinforcement of the sheets.

So called "low moisture permeability sheets", for example as disclosed in copending International Patent application No. PCT/AU96/00522 which is incorporated herein by reference, are particularly suitable for the method in accordance with the present invention. Such a low moisture permeability formulation reduces loss of strength due to moisture absorption quite dramatically as compared to conventional FRC sheets.

It is known in the art that lightweight concrete for use in manufacture of building panels is typically made by adding either pre-made air/water chemical foam or expanded lightweight aggregate beads to a water borne cement slurry. Typically, the lightweight aggregate concrete slurry which may be used with the present inventive method may comprise 50–70% by volume of expanded polystyrene granulate, 20–40% of sand, 5–15% of cement, 5–15% of water and 0–20% of fly ash, pulverised slag or other fine siliceous material. The density of lightweight aggregate concrete slurry ranges from 200 kg/m$^3$ to 1800 kg/m$^3$. In contrast, normal weight concrete has a density typically in the range 1800 kg/m$^3$ to 2600 kg/m$^3$.

Advantageously, additional material may also be included in the lightweight concrete slurry if the wall, floor or ceiling is designed for a particular purpose eg fire retardant for fire resistant walls, floors, ceilings etc.

BRIEF DESCRIPTION OF THE DRAWINGS

So that the present invention may be more clearly understood, a preferred embodiment will now be described, by way of example only, with reference to the accompanying drawings in which.

MODES FOR CARRYING OUT THE INVENTION

Figure 1:
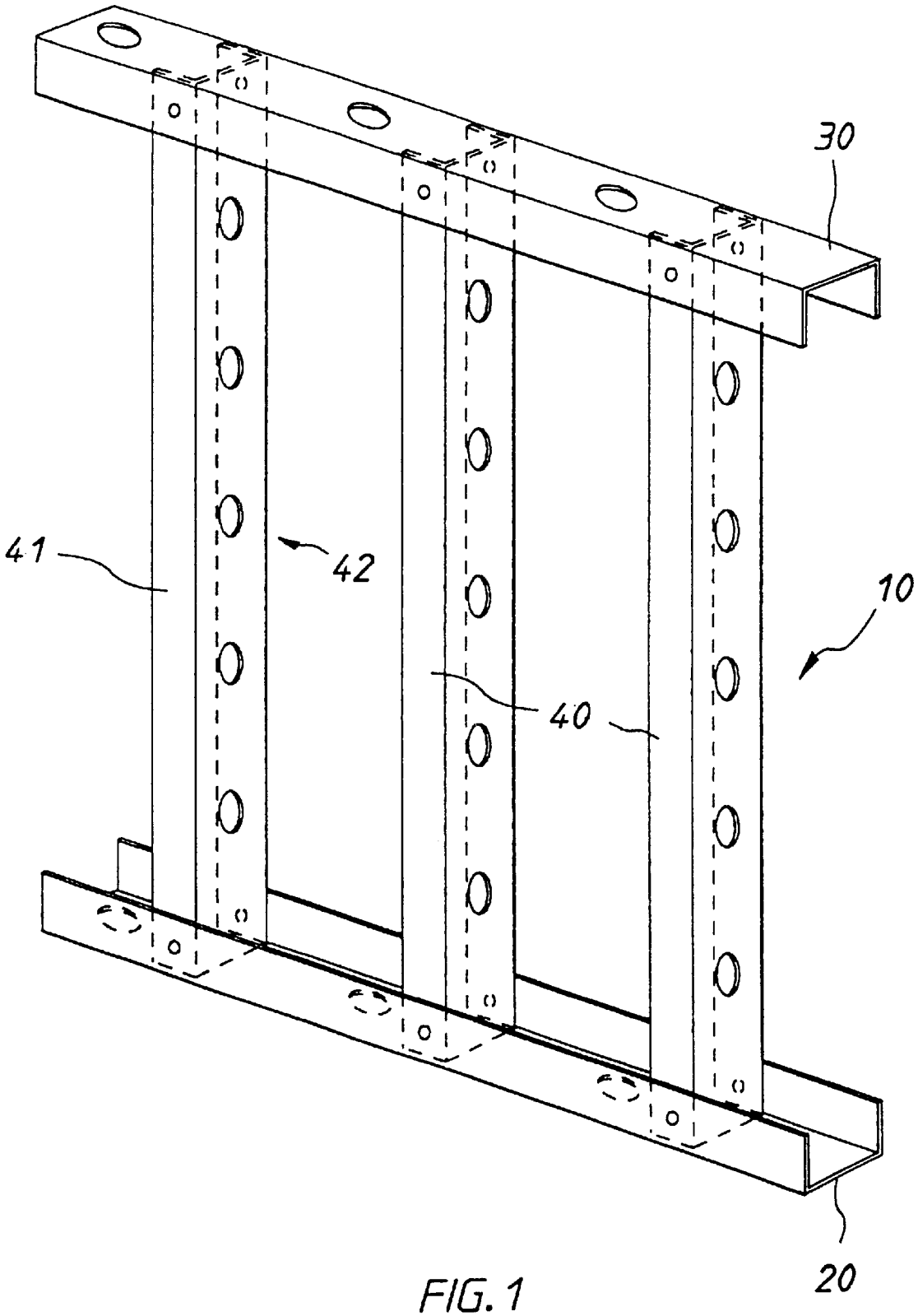
FIG. 1 is a perspective view of a frame suitable for use with a present inventive method

Turning firstly to FIG. 1, the first step in the inventive method is to provide a frame for the desired wall, floor or ceiling. The frame 10 is preferably constructed using conventional light gauge load bearing steel frames. In this case, the frame 10 comprises bottom rail 20, top rail 30 connected by substantially vertically oriented spaced apart studs 40.

Preferably each frame member has a minimum material thickness of 0.55 mm. In the embodiment shown, each frame member comprises an elongated "C" section channel member. Other cross-sections such as "Z", "I" are equally as suitable. Most preferably each frame member includes a pair of parallel spaced apart flanges 41, 42. These flanges not only serve to assist in attachment of the FRC sheets, as will be explained below, they also reinforce the wall, floor or ceiling.

Figure 2:
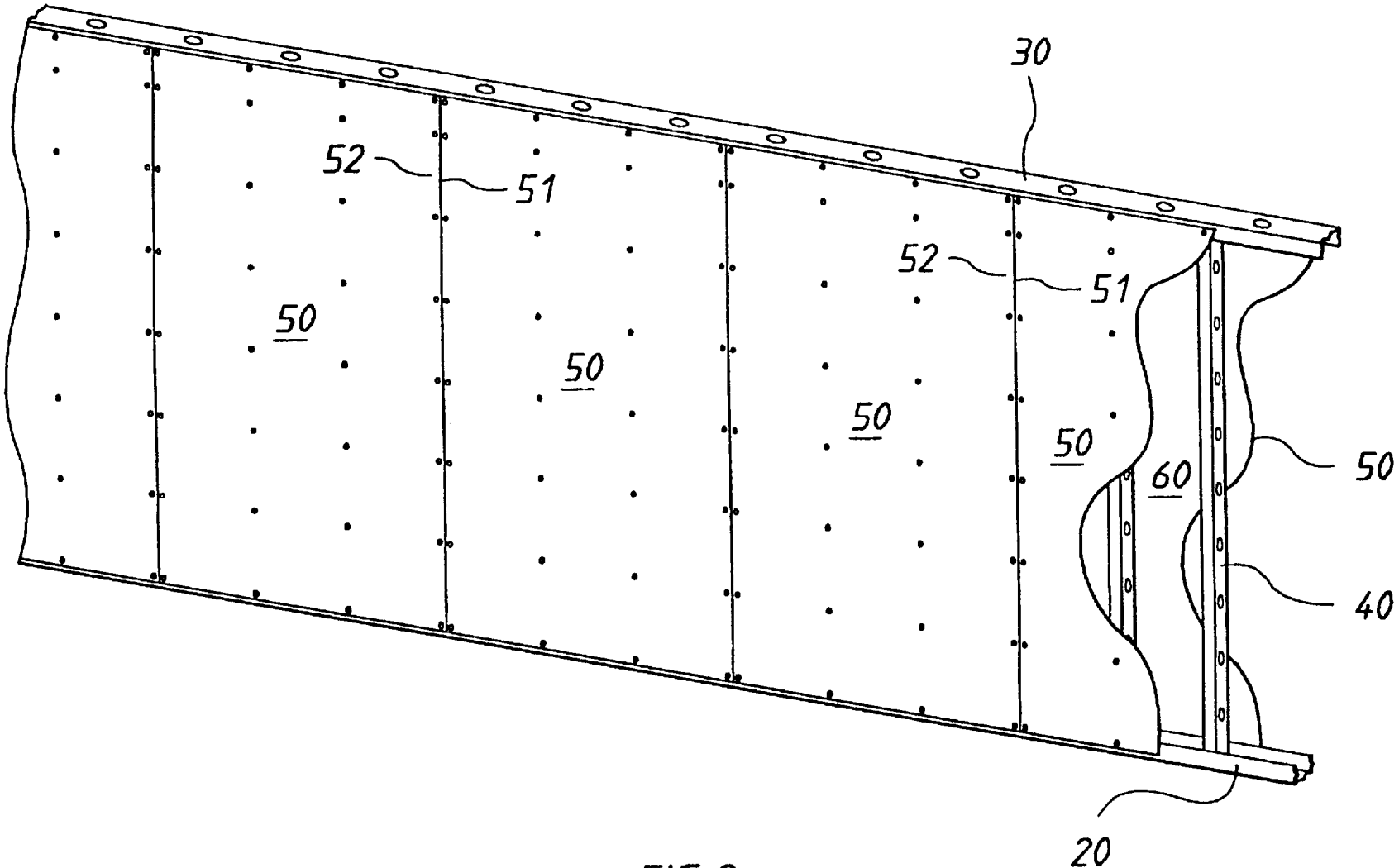
FIG. 2 is a perspective view of the frame of FIG. 1 clad in fibre reinforced cement sheets and FIGS. 3 and 3A are cross-sectional views through a complete wall, floor or ceiling as constructed by the present inventive method.

As shown in FIG. 2, the next step in the inventive method is to attach a number of fibre reinforced cement sheets 50 to the frame. These may be attached to the frame by any suitable mechanism however the applicants have found that screw fixing of the cement boards to the frame provides for reliable connection. Glue may be applied to the frame to hold the FRC sheets in place while screw fixing the cement boards to the frames. Preferably, edge portions 51, 52 or abutting sheets 50 are connected to a common stud 43. This reduces relative movement between abutting edges of sheets 50.

The lightweight aggregate slurry to fill the void 60 formed between the sheets has a nominal density between 200 and 1800 kg/m$^3$ most preferably around 400–500 kg/m$^3$. The lightweight cement slurry may be of conventional composition and can incorporate pulverised scrap polystyrene foam material ("grist") or expanded polystyrene beads, fly ash and/or other waste materials thereby providing useful recycling of waste products. Most preferably, the lightweight slurry has a low moisture content eg 50% water or less by weight. An example of a suitable lightweight concrete slurry composition is as follows. One cubic meter of slurry includes:

120 kg of cement 160 kg of fly ash 1 m$^3$ of polystyrene granulate 4 liters of air entraining agent, and approximately 150 liters of water Generally, a concrete agitator containing the cement/fly ash slurry will arrive on-site. To this is added the air entrainer which is mixed for an appropriate time eg two minutes. The polystyrene may then be added to the aerated slurry and while mixing, sufficient water added such that the resulting slurry will sit as a ball in the palm of the hand but readily flow if the hand is shaken slightly.

An alternative simpler method of producing a suitable concrete composition for use in the inventive method involves mixing 6 parts by volume of EPS (expanded polystyrene), 3 parts sand, 1 part cement and 1 part water. This slurry may be mixed on-site optionally with a foaming agent or air entrainer.

The slurry can be injected into the frame cavity through holes in the top plate 30 or by holes in the fibre cement sheeting 50. After pouring the cement slurry, the fibre reinforced cement sheets absorb moisture temporarily loosing their strength. The fibre reinforced cement sheets are chosen such that they absorb sufficient moisture to provide for natural adherence of the concrete but maintain their structural integrity during curing. As discussed above, it is preferred that the low moisture permeability fibre reinforced cement sheets, as exemplified in International Patent application No. PCT/AU96/00522, are used with inventive method. Such sheets preferably comprise an autoclaved cured reaction product of metakaolin, Portland cement, crystalline siliceous material and water along with other suitable additives such as fibre reinforcement.

Alternatively, low density sheets may be used. Low density boards typically have a density lower than 1200 kg/m$^3$ preferably 800–900 kg/m$^3$. Such low density sheets may absorb a greater amount of moisture than the abovementioned low permeability sheets however, such low density sheets are lighter and accordingly thicker sheets may be used thereby ensuring retention of their structural integrity during curing of the concrete.

For a wall with stud centres placed 300 mm apart, the preferred minimum thickness of the sheets, using conventional fibre reinforced cement sheets, is 6 mm. Using the abovementioned low permeability or low density boards the preferred minimum is also 6 mm.

If we space the studs further apart, however, for example to 400 mm, the thickness of the conventional fibre reinforced sheets must be increased to at least 9 mm. Surprisingly, however, the applicant has found that when using the abovementioned low permeability and low density boards, 6 mm thick board is still adequate to absorb sufficient moisture for adhesion of the concrete and maintain structural integrity during setting and curing of the concrete. By using such 6 mm thickness low permeability or low density board, it is possible to space the studs farther apart thereby providing a substantial reduction in both material and labour costs.

To provide adequate adhesion of the cured concrete and front and rear facing sheets 50, the sheets must absorb sufficient moisture. To test this moisture permeability, a sample of the intended facing sheet 50 is attached to the lower end of a vertical tube 50 mm in diameter. A 1.22 m high column of water is maintained in the tube and the moisture passing through the sheet over a 48 hour period is measured. For the conventional 6 mm sheet, the water permeation rate was 1–2 mm per hour. For the 6 mm low permeability sheet it was 0.5–1 mm per hour and for the 6 mm low density sheet it was 0.2–0.5 mm per hour. Each of these sheets has adequate moisture permeability to provide for adhesion of the sheet to the cured concrete.

The lightweight concrete should be pumped slowly into the void as a high flow rate will exert excessive pressure on the fibre reinforced cement sheets and vacant pockets may form in the wall cavity. It is not necessary to vibrate the lightweight concrete. Light tapping on the wall is all that should be required for compaction.

In another embodiment, the void may be filled in various stages. To explain, in order to reduce the weight to be supported by the moist fibre cement sheets, the void may be only partially filled eg. bottom one third and allowed to cure after which the middle one third may be filled and cured followed by the top third.

Figure 3:
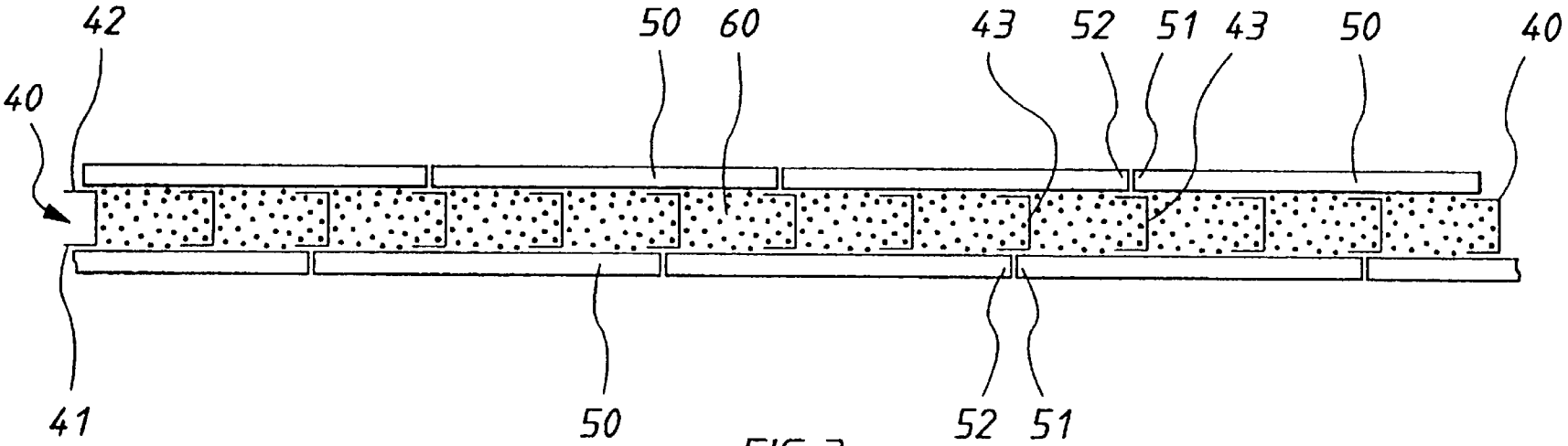

As shown in FIG. 3, the lightweight aggregate slurry entirely fills the void between the fibre reinforced sheets thereby providing a wall, ceiling or floor which is not only lightweight but looks and feels like conventional masonry.

In the embodiment shown the sheets 50 attached to the front and rear faces of the frame are staggered ie. off-set relative to each other. This is not essential to the invention and the sheets may equally be in relative alignment such that the edge portions 51,52 of respective front and rear facing sheets are attached to common studs 43.

Figure 3A:
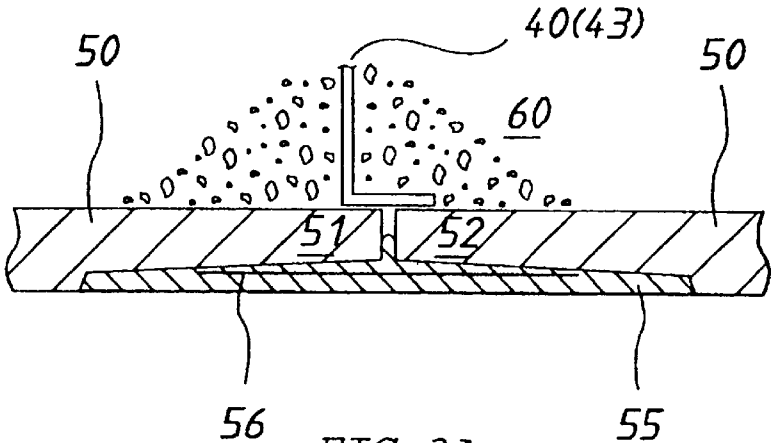

Further, in a preferred embodiment, the edge portions 51,52 are rebated as shown in FIG. 3A. A suitable joining compound 55 covers any gap between adjoining sheets, and a strip of reinforced tape 56 or similar then placed across the join and embedded in the joining compound.

Generally, the concrete should have fully cured within approximately 7 days of filling. At this time, any remaining pockets may be filled with further lightweight concrete slurry or cornice adhesive and general finishing of the wall, floor or ceiling completed.

The inventive method does not involve any new building trades or skills and is substantially faster than traditional masonry systems. The lightweight components used in the inventive method reduce transport and cranage costs and are infinitely flexible in terms of designs. There is no factory operation to produce panels or special components and all walls, floors or ceilings can be produces on-site. Of course, if designed as such, steel frames can be fully or partially completed prior to installation and brought to the construction site for cladding with the fibre reinforced cement sheets.

The lightweight concrete slurry may be of conventional composition and can incorporate scrap polystyrene, fly ash and other waste materials thereby providing useful recycling of waste products. Since the slurry penetrates and bonds to the fibre reinforced cement sheets, the wall sheeting it self is stabilised thereby minimising subsequent movements due to thermal and moisture effects. This enables simpler sheet stopping compounds to be used and reduces the likelihood of joint cracking between the sheets. Although the invention has been described with reference to the specific examples it will be understood by those skilled in the art that the invention may be embodied in many other forms.

What is claimed is:

1. A method of constructing a wall, floor or ceiling in situ, wherein said method includes the steps of:

erecting a substantially rigid frame defining front and rear faces of a wall, floor or ceiling;

attaching fibre reinforced cementitious sheets to said front and rear faces, to form a void therebetween;

injecting a lightweight aggregate concrete slurry with a density between about 200 kg/m$^3$ and 1800 kg/m$^3$ into said void; and allowing said concrete slurry to set and cure;

wherein said sheets absorb moisture at a rate greater than about 0.2 mm per hour to provide natural adherence of said concrete slurry to said sheets without substantially losing their structural integrity during setting and curing.

2. A method of constructing a wall, floor or ceiling in situ as claimed in claim 1 wherein the void is substantially filled with lightweight aggregate concrete slurry.

3. A method of constructing a wall, floor or ceiling in situ as claimed in claim 1, wherein the void is filled in stages by repeatedly filling a portion of the void with a lightweight aggregate concrete slurry and allowing that portion to cure prior to filling another portion of the void.

4. A method of constructing a wall, floor or ceiling in situ as claimed in claim 1, wherein said frame is constructed utilizing metal frame studs.

5. A method of constructing a wall, floor or ceiling in situ as claimed in claim 4, wherein said frame studs are one of a box section, "C" shaped channel section, "Z" section, or "I" section.

6. A method of constructing a wall, floor or ceiling in situ as claimed in claim 4, wherein said frame stud includes a plurality of parallel spaced apart flanges connected by a web, such that in use said flanges extend substantially adjacent and parallel to a respective front or rear facing sheet.

7. A method as claimed in claim 1, wherein the reinforced cementitious sheets are chemically fastened to said frame.

8. A method as claimed in claim 1, wherein said reinforced cementitious sheets are mechanically fastened to said frame.

9. A method of constructing a wall, floor or ceiling in situ as claimed in claim 1, wherein said lightweight concrete slurry includes a moisture content not more than about 50% of water.

10. A method of constructing a wall, floor or ceiling in situ as claimed in claim 1, wherein said concrete slurry includes materials selected from the group consisting of foaming agents, air entrainers, lightweight aggregate material, and a combination of any of the preceding materials.

11. A method of constructing a wall, floor or ceiling in situ as claimed in claim 1, wherein said lightweight aggregate slurry has a nominal density between about 400 kg/m$^3$ and 500 kg/m$^3$.

12. A method of constructing a wall, floor or ceiling in situ as claimed in claim 1, wherein each cubic meter of lightweight concrete slurry comprises about 120 kg of cement, about 160 kg of fly ash, about 1 m$^3$ expanded polystyrene granulate, about 4 liters of air entraining agent and about 150 liters of water.

13. A method as claimed in claim 1, wherein said lightweight aggregate concrete slurry comprises:

50–70% by volume of expanded polystyrene granulate;

20–40% sand;

5–15% cement;

5–15% water; and

0–20% fly ash, pulverized slag or other fine siliceous material.

14. A method of constructing a wall, floor or ceiling in situ as claimed in claim 1, wherein said sheets are constructed from low density fibre reinforced cement having a density between 800 kg/m$^3$ and 1200 kg/m$^3$.

15. A method of constructing a wall, floor or ceiling in situ as claimed in claim 1, wherein said sheets are constructed from low moisture permeability sheets.

16. A wall constructed by the method as claimed in claim 1.

17. A method of constructing a wall, floor or ceiling in situ as claimed in claim 1, wherein said sheets absorb moisture at a rate between 0.5 and 1 mm per hour.

18. A method of constructing a wall, floor or ceiling in situ as claimed in claim 1, wherein said sheets absorb moisture at a rate between 0.2 and 0.5 mm per hour.

19. A method of constructing a wall, floor or ceiling in situ as claimed in claim 1, wherein said sheets have a thickness of about 6 mm or more.

20. A method of constructing a wall, floor or ceiling in situ as claimed in claim 1, wherein said sheets have a density between 800 kg/m$^3$ and 1200 kg/m$^3$.

21. A method of constructing a wall, floor or ceiling in situ as claimed in claim 1, wherein said sheets have a density between 800 and 900 kg/m$^3$.

* * * * *